United States Patent [19]

Arya

[11] 4,445,808

[45] May 1, 1984

[54] MINE ROOF PLATE

[75] Inventor: Satya P. Arya, Somerville, N.J.

[73] Assignee: Ingersoll-Rand Company, Woodcliff Lake, N.J.

[21] Appl. No.: 300,773

[22] Filed: Sep. 10, 1981

Related U.S. Application Data

[63] Continuation-in-part of Ser. No. 99,836, Dec. 3, 1979, abandoned.

[51] Int. Cl.[3] ..... E21D 21/00

[52] U.S. Cl. ..... 405/259; 411/531

[58] Field of Search ..... 405/259, 260, 261, 262, 405/288; D8/399; 411/531

[56] References Cited

U.S. PATENT DOCUMENTS

| | | | |
|---|---|---|---|
| D. 236,428 | 8/1975 | Stewart et al. | D8/399 |
| 2,748,594 | 6/1956 | Edwards | 405/259 X |
| 2,854,824 | 10/1958 | Curry et al. | 405/259 |
| 4,037,418 | 7/1977 | Hannan | 405/259 |
| 4,112,693 | 9/1978 | Collin et al. | 405/259 X |

FOREIGN PATENT DOCUMENTS

| | | | |
|---|---|---|---|
| 2624233 | 12/1977 | Fed. Rep. of Germany | 405/259 |
| 941173 | 11/1963 | United Kingdom | 405/259 |

*Primary Examiner*—David H. Corbin

*Attorney, Agent, or Firm*—B. J. Murphy

[57] ABSTRACT

The mine roof plate comprises a rigid, sheet steel element of substantially uniform thickness having a domed section which reinforces the plate against distortion. The domed section is at least partially of generally quadrilateral configuration, having a substantially square base and defines an elevated section having an aperture therein circumscribed by a generally planar land surface. The periphery of the plate is of planar, rectangular configuration and disposed in spaced parallel relationship to the elevated section. The configuration of the domed section, in having right-angular corner portions, defines thereby reinforcing ribs, along the domed section, which terminate at the planar periphery of the plate.

8 Claims, 2 Drawing Figures

MINE ROOF PLATE

Figure 1:
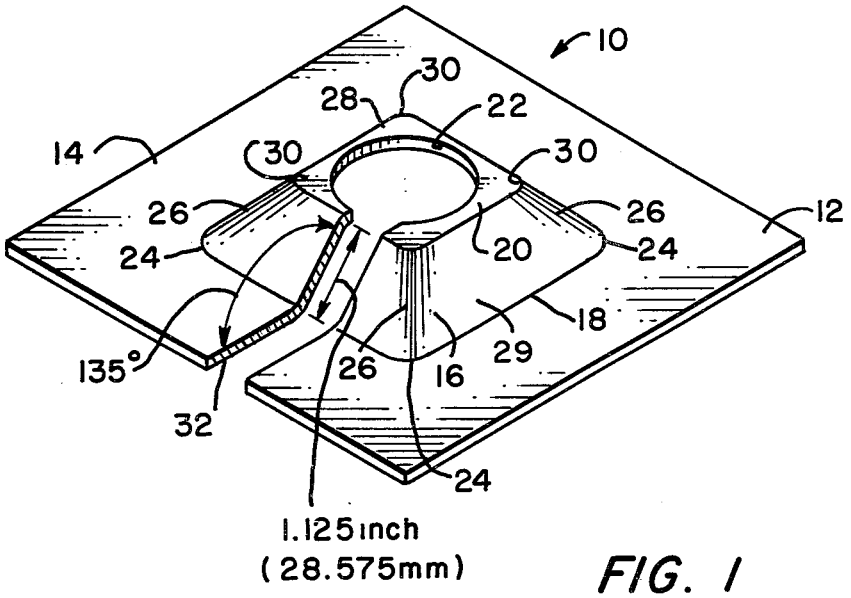

This is a continuation-in-part of Ser. No. 099,836, filed Dec. 3, 1979, now abandoned.

This invention pertains to mine roof plates and, more particularly, to a plate of relatively thin material adapted to be used within subterranean areas, such as mines.

Mine roof plates are especially designed for use in mines, tunnels, rock cuts, and other excavations, with roof bolts to bind together the various rock strata so as to stabilize the rock formation and prevent its collapse. Conventionally, such plates are used with a rock bolt having a bolt anchoring device mounted on its inner end for receipt within a hole bored in the rock to be reinforced. The anchoring device used with the bolt may form a mechanical or chemical anchorage.

The prior art relating to support plates of the type to which the present invention is directed is best exemplified by U.S. Pat. No. 4,112,693, issued Sept. 12, 1978, to A. L. Collin, et al., for a Mine Roof Support Plate. The patentees disclose a sheet metal support plate designed to meet industry-prescribed standards for deflection and load-carrying ability. A new type of roof stabilizer, coming into use, comprises a longitudinally split tube. The latter is best exemplified by U.S. Pat. No. 3,922,867, issued to James J. Scott, on Dec. 2, 1975, for a Friction Rock Stabilizer. The mine roof plates known in the prior art are not quite suitable for these more unconventional friction rock stabilizers and, accordingly, the instant invention arose from an undertaking to design a mine roof plate more suitable for the friction rock stabilizers. In the course of the engineering effort, it was discovered that it is possible to configure a mine roof plate (a) from mild carbon steel sheet material which will meet the deflection and load-carrying requirements of ANSI/ASTM Specification F 432-77, with approximately one-third less material than the prior art roof plates, or (b) from low alloy high strength steel (60,000 p.s.i. yield) material which will meet the deflection and load-carrying requirement of ANSI/ASTM specification F 432-77 with approximately 46% less material than the prior art roof plates, yielding a lighter-weight and less expensive roof plate.

It is an object of this invention, therefore, to provide a mine roof plate adapted to be used with friction rock stabilizers. It is also an object of this invention to provide a significantly lightweight, steel, mine roof plate meeting the requirements of ANSI/ASTM Specification F 432-77.

Particularly, it is an object of this invention to set forth a mine roof plate having a load-carrying capacity of not less than 23,000 pounds (10432.8 kg.), to as much as 35,000 pounds (12,247.2 kg.), comprising a rigid, quadrilateral plate; said plate having a substantially-central portion thereof raised from, or in relief relative to, a generally flat, peripheral portion thereof; and said central portion comprises a base, about which said peripheral portion subsists, and a dome elevated from said base with an aperture formed in said dome substantially centrally thereof; wherein said base is of substantially square configuration, having radiused, substantially right-angular corner portions formed therein, and ribs which rise from said corner portions and said peripheral portion to define said dome; said ribs being of radiused, substantially right-angular configurations (a) where they join said corner portions, and (b) along a length of each thereof which rises from said corner portions; said plate is of a substantially uniform thickness; and said uniform thickness is not more than approximately 0.158-inch (4.0132 mm.) to a minimum of approximately 0.121-inch (3.0734 mm.).

Figure 2:
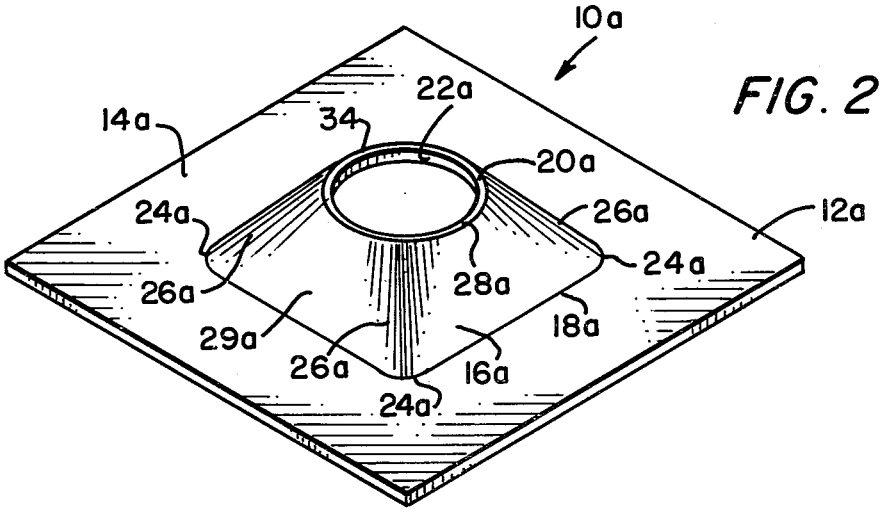

Further objects of this invention, as well as the novel features thereof, will become more apparent by reference to the following description, taken in conjunction with the accompanying figures in which:

FIG. 1 is an isometric projection of an embodiment of the inventive mine roof plate; and FIG. 2 is also an isometric projection of an alternative embodiment of the novel mine roof plate. In both figures the roof plates are shown in inverted attitudes relative to their use with mine roofs. That is to say that the seemingly "underlying" or obscured surfaces of the plate embodiments are those which engage or interface with the roofs of the mine.

As shown in FIG. 1, the first embodiment 10 of the invention comprises a steel plate 12 which is six inches (152.4 mm.) square, having a flat, peripheral portion 14 from which, and centrally thereof, arises a domed section 16. The domed section has a substantially square base 18 rising from the peripheral portion 14 to a substantially square crown 20. The crown 20, necessary to provide a seat for a friction rock stabilizer, has a central aperture 22 within which to receive a friction rock stabilizer. It was discovered that, designing the base 18 with a substantially square configuration, and the domed section 16 with right angular corner portions 24, which rise therealong from the peripheral portion 14, provides ribs 26 possessed of such strength and rigidity as to allow the plate to be formed from relatively thin sheet steel material.

In the disclosure of the aforementioned U.S. Pat. No. 4,112,693, it is explained by the patentees that their plate is formed of mild carbon steel having a thickness of about 0.1725-inch (4.38 mm.) to about one-quarter inch (6.35 mm.). In the instant invention, by forming a substantially square base 18 with right-angular corner portions 24 with ribs 26 rising therefrom to the crown 20 of the domed section 16, it is possible to form the roof plate 10 of mild carbon steel, or low-alloy, high-strength steel of 60,000 p.s.i. yield, having a thickness of from about 0.148-inch (4.0132 mm.) to as thin as approximately 0.121-inch (3.0734 mm.), respectively, and still meet the deflection and load-carrying criteria of ANSI/ASTM Specification F 432-77.

FIG. 2 shows a roof plate in an alternative embodiment **10*a*, according to the invention, in which a domed section 16*a* terminates in a circular crown 20*a* and wherein ribs 26*a* rise from a substantially square base 18*a* adjoining a peripheral portion 14*a*, the ribs 26*a* diminishing before they reach the crown 20*a*. In both embodiments, the elevated or domed sections 16 and 16*a* each have an aperture which is circumscribed by a substantially flat land portion 28 or 28*a*** of not less than 0.15-inch (3.81 mm.) in width.

Embodiment 10 has a base 18 which is 3.25-inch (82.55 mm.) square. The aperture 22 is 1.60-inch (40.64 mm.) in diameter. The crown 20 is 1.75-inch (44.45 mm.) square excepting the radiused corners 30 thereof. The crown 20 joins the side wall 29 of the domed section 16 through a 0.125-inch (3.175 mm.) radius, and the side wall 29 joins the peripheral portion 14 through a 0.1875-inch (4.76 mm.) radius. The radiused, substantially right-angular corner portions 24 of the base 18 define 0.3125-inch (7.93 mm.) radius turns, whereas the corners 30 of the crown 20 define 0.1875-inch (4.76 mm.) radius turns. The depth (or height) of the plate 10, from the "underlying" or obscured surface 32 to the top of the crown 20 is but one inch (25.40 mm.).

Crown 20 and land 28 transfer the friction rock stabilizer load to the plate dome walls 29. This arrangement minimizes bending stresses at the juncture where crown meets the domed section 16. This juncture was found to be highly stressed in plates of prior design, resulting in plate failure.

Domed section 16 is shaped like a pyramid to minimize bending stresses and to transfer the stabilizer load to the peripheral portion 14 primarily by compressive stresses.

Domed section 16 also is stiffened by ribs 26 to strengthen the dome column against buckling due to compressive loading, and against bending due to the loading of crown 20 being offset from the peripheral portion 14.

ANSI/ASTM Specification F 432-77 requires positioning of a plate over a four-inch diameter hole for testing. The size of the base 18 (i.e., 3.25-inch or 82.55 mm. square) is designed to minimze bending stresses in the portion of the plate 10 contained within the four-inch diameter area of the test hole. This has been another, highly stressed area of priorly-designed plates which result in failure.

Embodiment 10*a* has a base 18*a* which is 3.38-inch (85.85 mm.) square excepting radiused corner portions 24*a* thereof. Aperture 22*a* is of 1.39-inch (35.30 mm.) in diameter. The crown 20*a*, however, has an outside diameter of 1.75-inch (44.45 mm.). The crown 20*a* joins the side wall 29*a* through a same 0.125-inch (3.175 mm.) radius, however, the side wall 29*a* joins the peripheral portion 14*a* through a 0.12-inch (3.05 mm.) radius. The right-angular corner portions 24*a* of the base 18*a* define same 0.3125-inch (7.93 mm.) radius turns and, of course, the crown 20*a* defines the flat annular or land 28*a*; the latter is 0.15-inch (3.81 mm.) in width.

While I have described my invention in connection with specific embodiments thereof, it is to be clearly understood that this is done only by way of example, and not as a limitation to the scope of my invention as set forth in the objects thereof and in the appended claims.

I claim:

1. A mine roof plate, having a load-carrying capacity within a range of not less than 23,000 pounds (10432.8 kg.) to 35,000 pounds (12,247.2 kg.), comprising:

a rigid plate formed of steel;

said plate having a substantially-central portion thereof raised from, or in relief relative to, a generally flat, peripheral portion thereof; and said central portion comprises a base, about which said peripheral portion subsists, and a dome elevated from said base, the uppermost portion of which dome is of circular configuration, with an aperture, having a diameter taken from a range of from 1.39 to 1.60-inch, formed in said dome substantially centrally thereof; wherein said base has rectilinear sides which are joined at ends thereof through radiused, corner portions;

said plate is of a substantially uniform thickness;

said uniform thickness is not more than a maximum of approximately 0.158-inch (4.0132 mm.) to a minimum of approximately 0.121-inch (3.0734 mm.);

said central portion has sides, joining said base and said uppermost portion of said dome, which fair the linearity thereof, defined by said rectilinear sides of said base, to arcuate conformations thereof, defined by said circular configuration; whereby successive cross-sections of said dome, from said base to said uppermost portion thereof, transform from a rectilinearly-sided, substantially square shape to a circular shape; and said dome has a flat, terminal land surface, circumscribing said aperture, having a width dimension which is less than said maximum thickness dimension of said plate.

2. A mine roof plate according to claim 1, wherein:

said aperture has a prescribed diameter;

said plate has a given width; and said diameter is approximately one-quarter of said given width.

3. A mine roof plate according to claim 1, wherein:

said dome rises from said base less than one inch (25.40 mm.).

4. A mine roof plate, according to claim 1, wherein:

said flat terminal land surface, circumscribing said aperture, is approximately 0.15 inch (3.81 mm.) in width.

5. A mine roof plate, according to claim 1, wherein:

said dome encompasses approximately one-third of the area of said plate.

6. A mine roof plate, according to claim 4, wherein:

said dome is formed of a continuous wall, contiguous with both said land and said peripheral portion, which forms an oblique angle with said peripheral portion.

7. A mine roof plate, according to claim 4, wherein:

said wall has a width dimension measured between said land and said peripheral portion, of not less than 1.125 inches (28.575 mm.).

8. A mine roof plate, according to claim 1, wherein:

said flat, terminal land surface, circumscribing said aperture, has a diameter of approximately 1.75 inches (44.45 mm.).

* * * * *